US005902194A

United States Patent [19]

Wade

[11] Patent Number: 5,902,194

[45] Date of Patent: May 11, 1999

[54] SOCCER GOAL APPARATUS

[76] Inventor: Joseph B. Wade, 7442 Blue Creek South Dr., Indianapolis, Ind. 46256

[21] Appl. No.: 08/738,446

[22] Filed: Oct. 25, 1996

Related U.S. Application Data

[63] Continuation-in-part of application No. 08/405,796, Mar. 16, 1995, abandoned.

[51] Int. Cl.[6] ..... A63B 63/00

[52] U.S. Cl. ..... 473/446; 273/400; 473/478

[58] Field of Search ..... 273/398, 400, 273/402; 473/476, 478, 446

[56] References Cited

U.S. PATENT DOCUMENTS

| | | | |
|---|---|---|---|
| 1,279,066 | 9/1918 | Woods . | |
| 1,409,928 | 3/1922 | Clark . | |
| 1,458,571 | 6/1923 | Clark . | |
| 3,079,657 | 3/1963 | Russell | 24/598.6 X |
| 4,594,847 | 6/1986 | Klier et al. | 59/85 |
| 4,842,284 | 6/1989 | Rushing et al. | 473/478 X |
| 4,948,147 | 8/1990 | Pallanca | 273/402 |
| 5,181,725 | 1/1993 | Leras et al. | 273/402 |

*Primary Examiner*—William H. Grieb
*Attorney, Agent, or Firm*—Brinks Hofer Gilson & Lione

[57] ABSTRACT

A particularly flexible soccer goal target can be formed by using a plurality of fasteners or clips to attach together a plurality of strips of netting into a target assembly. The plurality of strips of netting are fastened or clipped together, edge to edge, to form a net assembly having sufficient width and height to extend across a substantial portion of the entrance of the soccer goal. The strips of netting, which are fastened or clipped together to form the target assembly, may be easily disconnected by unclipping them at different locations of the goal entrance to provide openings in the target assembly at different positions in the goal that will serve as targets for practice. Further, both the soccer net and flexible soccer goal may be provided at their peripheries with a plurality of spaced permanently attached cord-formed attachment means.

16 Claims, 8 Drawing Sheets

SOCCER GOAL APPARATUS

This is a continuation in part of U.S. patent application Ser. No. 08/405,796, filed Mar. 16, 1995, now abandoned.

FIELD OF THE INVENTION

This invention relates to a clip for attaching two cords together and to a soccer goal practice device that may use such clips. This invention relates, more particularly, to a clip that may be used to link the net and the framework of a soccer goal and may also be used to link strips of netting in such a fashion that, with the variable placement of the clips, target openings may be formed in a variety of positions over the entrance of a soccer goal.

BACKGROUND OF THE INVENTION

In the past, the soccer net used to catch a soccer ball within the confines of a soccer goal has been attached to the goal framework by inserting a cord or lanyard through an opening of the netting and spiralling the cord or lanyard around the goal framework, inserting the cord or lanyard through the next opening of the netting and spiraling the cord or lanyard around the goal framework and so on, continuing the process of threading the cord through openings in the net and around the goal framework until the net is held in position on the soccer goal framework by the cord or lanyard. As can be appreciated, this method of attachment is tedious and time-consuming and has been particularly undesirable where publicly-available soccer fields are used by grade schools, high schools, children's leagues and the like, where the personnel associated with the team have to go through the tedious installation procedure and then remove their soccer nets by using this process and its reverse.

BRIEF STATEMENT OF THE INVENTION

This invention provides a clip and method by which two cords or lines may be easily connected together. For example, clips and methods of the invention may be used conveniently to attach the periphery of a soccer net to a soccer goal framework, e.g., to a cord or lanyard that has been permanently attached to a soccer goal framework, for example, by spiral wrapping a cord or lanyard around the goal framework, or by providing the periphery of a soccer net with a plurality of loops suitable for engagement with the soccer goal framework, or any other suitable method of attaching cording to the framework of a soccer goal as means for connecting a soccer net to the goal framework A clip of the invention can comprise a central interconnecting portion with two outwardly-extending, cord-engaging portions, such portions being formed by two pairs of adjacent incomplete loops extending outwardly from the central portion and forming a pair of interconnected eyelets. Each incomplete loop can include a hooked distal portion which lies adjacent the hooked distal portion of the other incomplete loop, and the two adjacent hooked distal portions form a cord entrance so that upon insertion of a cord between the hooked distal portions of the incomplete loops, the cord will be entrapped in the eyelet formed thereby.

Thus, the invention can provide a soccer net attachment device comprising means forming a pair of interconnected, cord-engaging loops, each of which is formed by a pair of hook-like curved portions extending outwardly and adjacent to each-other in an opposed relationship to form a cord-engaging loop with their adjacent distal hook-like ends. The soccer net attachment device can be preferably formed from a durable, resilient plastic, such as polypropylene, by injection molding, and the resulting resiliency of the hook-like curved portions can hold the hook-like portions forming the cord entrance into a closed, adjacent touching relationship, yet permit the cords to be easily pushed between the hook-like curved portions for entrapment in the cord-engaging loops formed by the device.

A particularly flexible soccer goal target can be formed by using a plurality of fasteners or clips to attach together a plurality of strips of netting into a target assembly. The plurality of strips of netting are fastened together, edge to edge, to form a net assembly having sufficient width and height to extend across a substantial portion of the entrance of the soccer goal. The strips of netting, which are fastened or clipped together to form the target assembly, may be easily disconnected at different locations of the goal entrance to provide openings in the target assembly at different positions in the goal that will serve as targets for players practicing their shooting.

Clips of the invention may be used, and are generally preferred, to interconnect the strips of netting into the target assembly and to attach the target net assembly to the goal framework that forms the entrance to the goal.

DETAILED DESCRIPTION OF THE DRAWINGS

FIGS. 1–4 illustrate a clip of the invention;

FIG. 1 shows a view of the clip of the invention from the side;

FIG. 2 shows a view of the clip from FIG. 1 from the end;

FIG. 3 shows a view of the clip of FIG. 1 from the bottom;

DETAILED DESCRIPTION OF THE INVENTION

Figure 2:
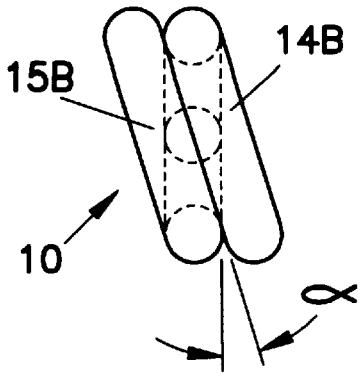

The following detailed description is of one preferred embodiment of the invention. Those skilled in the art will recognize that clips of the invention may be formed by departing from the detailed shapes and features described as comprising the presently preferred embodiment illustrated in the drawings and described below.

FIGS. 1–4 illustrate a clip 10 of the invention in a preferable form for injection molding with a resilient, durable plastic material, such as polypropylene.

Figure 1:
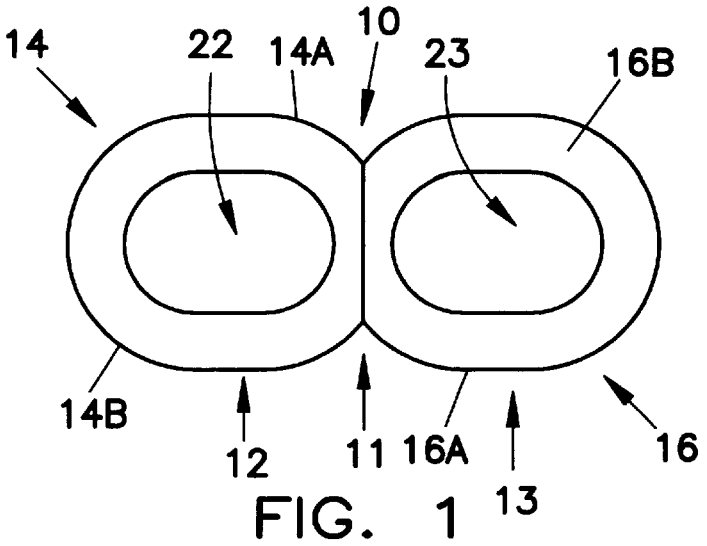
Figure 3:
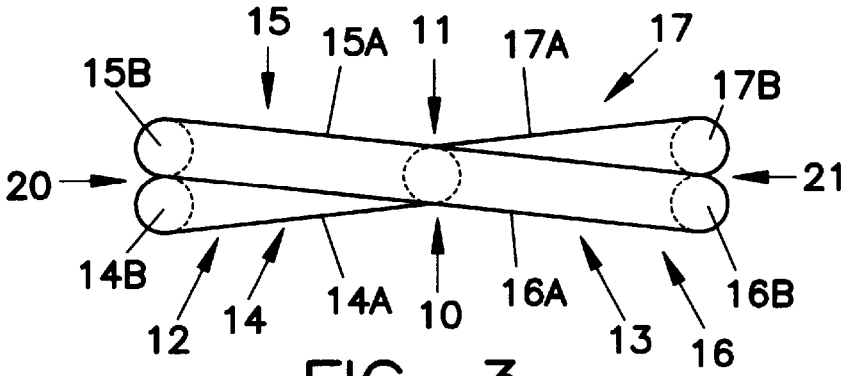

As shown in the figures, the clip 10 includes a central portion 11 that interconnects two outwardly-extending, eyelet-forming and cord-engaging means 12 and 13. As shown in FIGS. 1, 3 and 4, in the preferred embodiment the cord-engaging means 12 and 13 extend outwardly from the interconnecting central portion 11 in a 180° opposed relationship. It will be recognized by those skilled in the art that cord-engaging means 12 and 13 may extend outwardly at angles departing from 180°, although angles other than 180° are not preferred.

Each of the outwardly-extending, cord-engaging means 12, 13, is formed by a pair of incomplete loops, 14, 15 and 16, 17, respectively. Each of the incomplete loops comprises an inner portion 14*a*–17*a* extending outwardly from the central interconnecting portion 11 and terminating in a distal hooked end 14*b*–17*b*, respectively. As shown in FIGS. 3–4, the hooked distal portions 14*b* and 15*b* of incomplete loop 12 lie adjacent to each other in an opposed relationship and form a cord entrance indicated at 20, and the hooked distal portions 16*b* and 17*b* of incomplete loop 13 lie adjacent to each other in an opposed relationship and form a cord entrance indicated at 21. As shown in FIG. 1, the pairs of incomplete loops 14, 15 and 16, 17, respectively, lie in opposed adjacent relationship; that is, the inner most portions 14*a*–17*a* extend from adjacent the termini of the adjacent hooked distal portions 14*b* to 17*b* to form a cord-engaging eyelets 22 and 23, respectively.

Figure 4A:
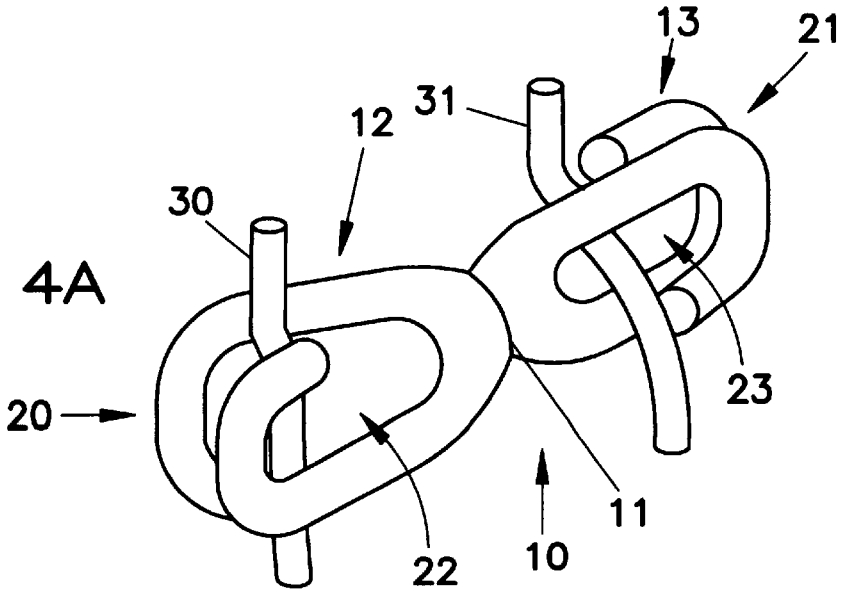
FIG. 4A is a perspective view of the clip of FIGS. 1–3 illustrating the manner in which it is used to interconnect two cords.

As shown in FIG. 4A, the clip of FIGS. 1–3 is used to attach two cords together by inserting one cord 30 to be connected through cord entrance 20 between the distal hook-like portions 14*b* and 15*b* of the outwardly extending cord-engaging means 12, and inserting the other cord 31 to be connected into the cord entrance 21 formed by the distal hook-like portions 16*b* and 17*b* of the outwardly extending cord-engaging means 13. The cords to be connected 30 and 31, become entrapped in the cord-engaging eyelets 22 and 23, respectively, once they are urged past the terminus of the distal hook-like portions 14*b*, 15*b*, 16*b* and 17*b*, respectively, as illustrated by cord 31 in FIG. 4A.

Figure 4B:
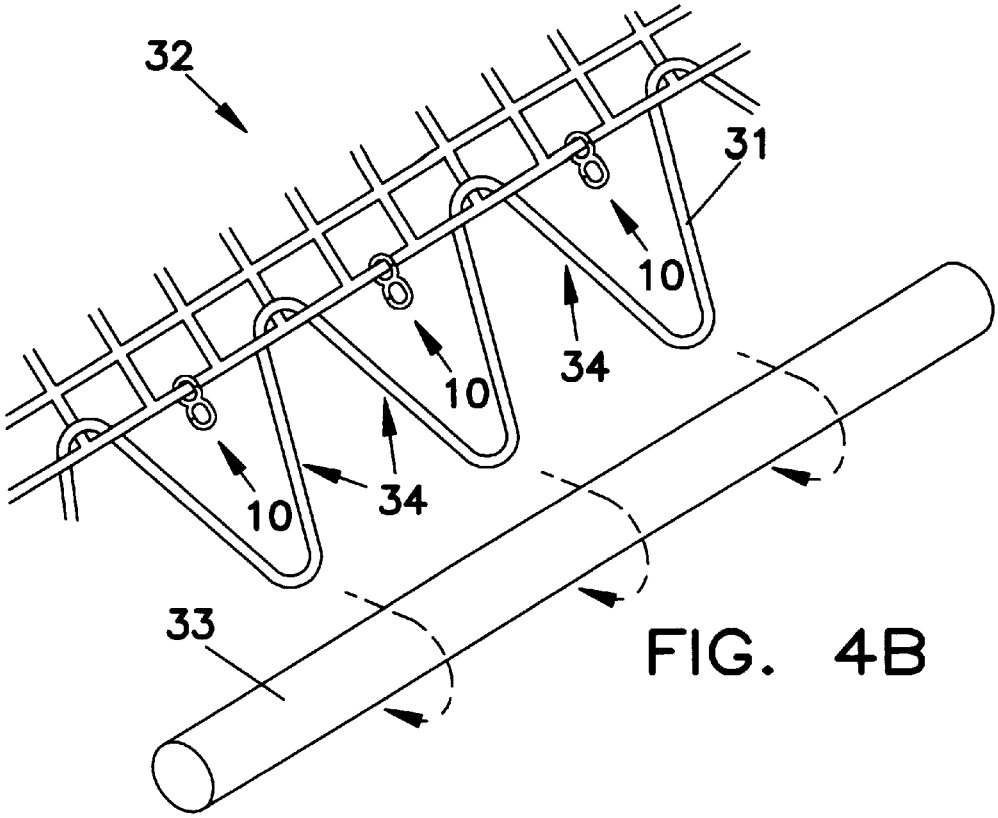
FIG. 4B is a perspective view of a preferred method of attachment of a soccer net to a goal framework.
Figure 4C:
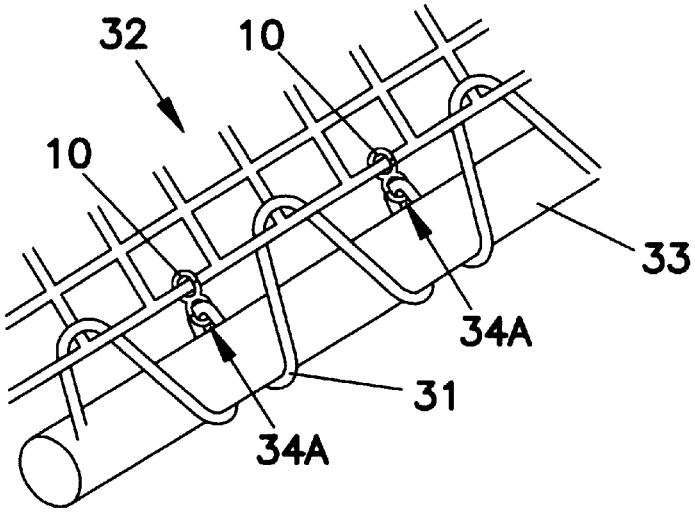
FIG. 4C is a partial perspective view of a soccer goal framework and soccer net attached with the clips of FIGS. 1–4.

FIGS. 4B and 4*c* show a preferred method by which clips 10 of the invention may be used to attach a soccer net to a goal framework. This same method may be used to interconnect strips of netting in the target goal assembly described below.

In this preferred attachment method, a plurality of clips 10 are attached to the netting 32, and a cord 31 is laced through the net openings of a soccer net 32 spaced from the clip attachments, skipping several net openings, as shown in FIG. 4B. Enough cord 31 is used so that it extends outwardly from the soccer net 32 in a plurality of loops 34 that may be wrapped around the goal framework 33, as indicated by the broken-line arrows of FIG. 4B. The ends 34*a* of the loops 34 may then be attached to the clips 10 to secure the netting 32 to the goal framework 33 through the cord 31. This same method may be used to interconnect two strips of netting by lacing the cord 31 through the net openings of one strip of netting which has attached to it a plurality of clips 10, as described above, and threading the loops 34 through the net openings of an adjacent strip of netting and attaching the loop ends 34*a* to the plurality of clips. This method of interconnecting a soccer net to a goal and interconnecting two strips of soccer netting is preferred because it reduces the number of clips 10 needed. The "frequency" of the lacing may be varied to balance number of clips required versus an acceptable separation of cord.

Once the cord has been laced through the net and the clips attached, the cord and clips can remain with the net indefinitely. Thus, while other methods require lacing the net each time it is installed, this method requires lacing only once. Since it typically takes a group of four people 30 minutes to attach a net by the spiraling method described above, my method represents a significant time savings. Further, since the net can be attached and detached quickly, it is now practical to detach the net after use and store it, addressing the problems of net theft and weathering facing many soccer programs.

Figure 5A:
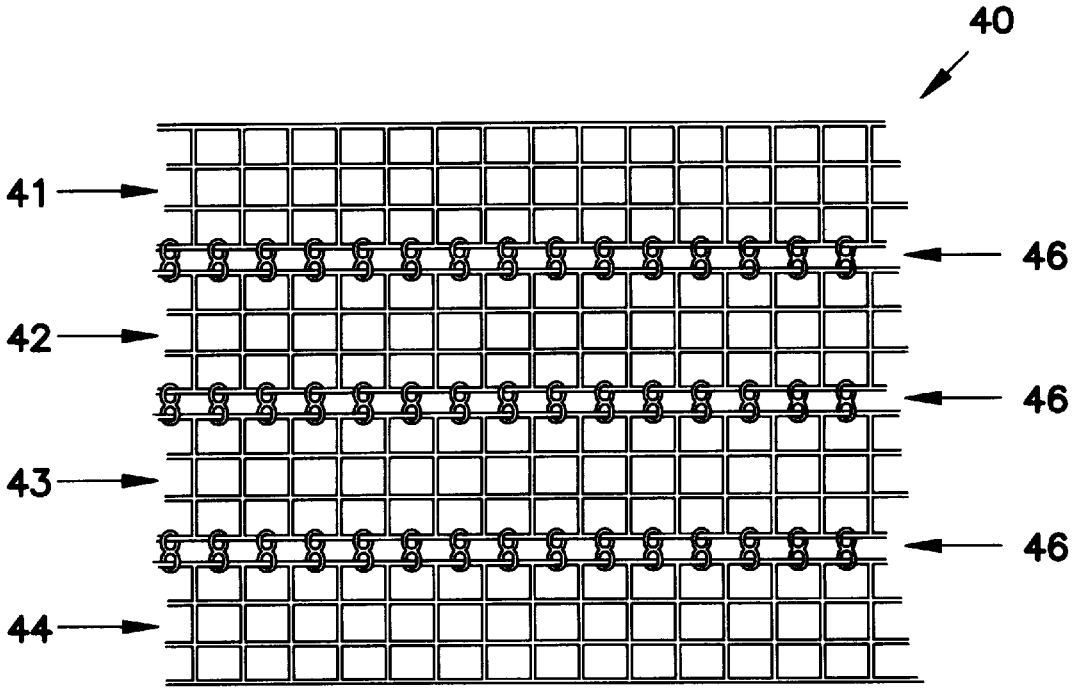
FIG. 5A is a drawing illustrating a portion at a target assembly of the invention.
Figure 5B:
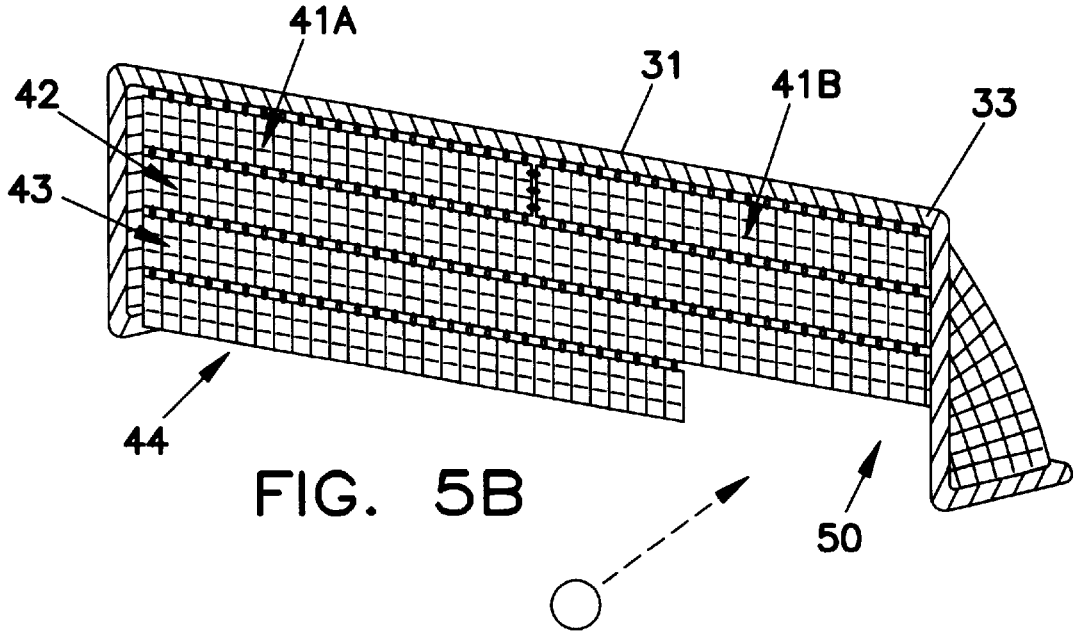
FIG. 5B is a drawing illustrating one target assembly of the invention being used in a soccer goal entrance to form a target opening.

Although the method shown in FIGS. 4B and 4C is preferred, the clip 10 of the invention may be used to attach a soccer net 32 to a soccer goal framework 33, by any convenient means, for example, by wrapping a cord tightly around the soccer goal framework 33 in a spiral to provide series of spaced cord portions inside the goal framework for attachment to one of the cord-engaging eyelets 12 of the clip 10 (as shown in FIG. 5B), the other cord-engaging eyelet 13 of the clip 10 thereafter being used to engage the cord 31 forming the periphery of the soccer net within one of its peripheral openings. Such a method of attachment is shown in FIG. 4A and FIG. 5B.

Figure 6A:
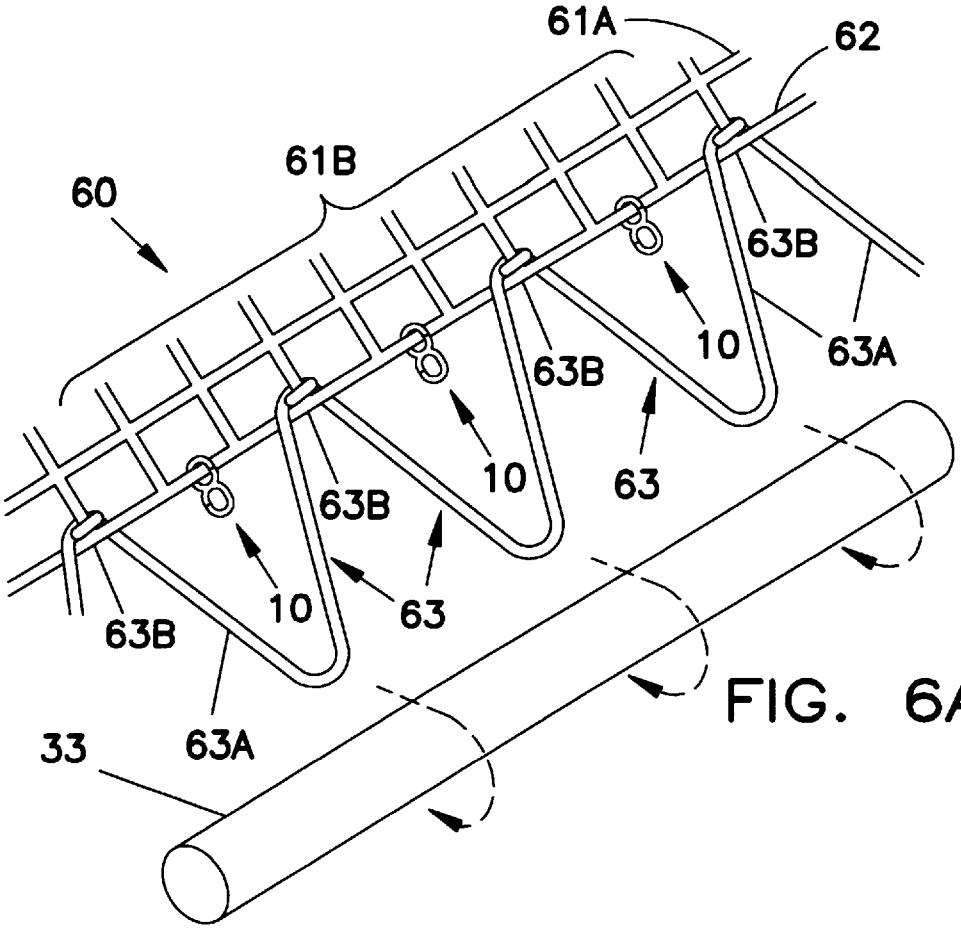
FIG. 6A is a drawing of soccer netting of the invention with means for use with a plurality of clips in attaching the netting to a soccer goal.

The invention also provides improved soccer netting and means for attachment of soccer netting to a goal. As shown in FIG. 6A, new soccer netting 60 of the invention comprises a traditional soccer net portion 61 comprising a plurality of cords 61*a* and 61*b* interconnected to form soccer netting with a plurality of openings, as well known in the art; however, in the invention, a cord (or cords) 62 at the periphery of the netting is provided with a plurality of net attachment means 63 permanently connected to the cord (or cords) 62. As shown in FIG. 6A, the plurality of net attachment means 63 of the soccer netting comprise a series of loops 63 formed from a cord 63*a* that is attached (or from a plurality of cords that are attached) at spaced intervals 63*b* to the cord (or cords) 62 that form, the periphery of the soccer netting. As shown in FIG. 6A, the cord 63*a* is deformable into a series of triangular loops 63. Although the attachment means 63, as shown in FIG. 6A, can form triangular-shaped loops, the triangular loop shape is unnecessary and the attachment means 63 may be simple loops in spaced attachment to the net periphery although such attachment means is less preferred.

The new soccer netting 60 of my invention can be used at the periphery of an entire soccer goal net, or can be used at the peripheral parts of my new flexible target goal assembly, as described below. My invention can provide even greater ease of attachment of a soccer net to a soccer goal than the methods described above with respect to FIGS. 4B, 4C and 5B. In the new soccer netting 60, the loops 63 (that are formed by a separate cord 31 in the methods illustrated by FIGS. 4B, 4C and 5B) are made a permanent part of the soccer netting by tying, sewing, stapling or otherwise attaching them to a peripheral cord 62 of the soccer netting, and the new soccer net 60 may be easily attached, as indicated in FIGS. 6A and 6B, and FIGS. 9–15 to a soccer goal using a plurality of clips, such as the clips shown in FIGS. 1–3 and 8.

Figure 8:
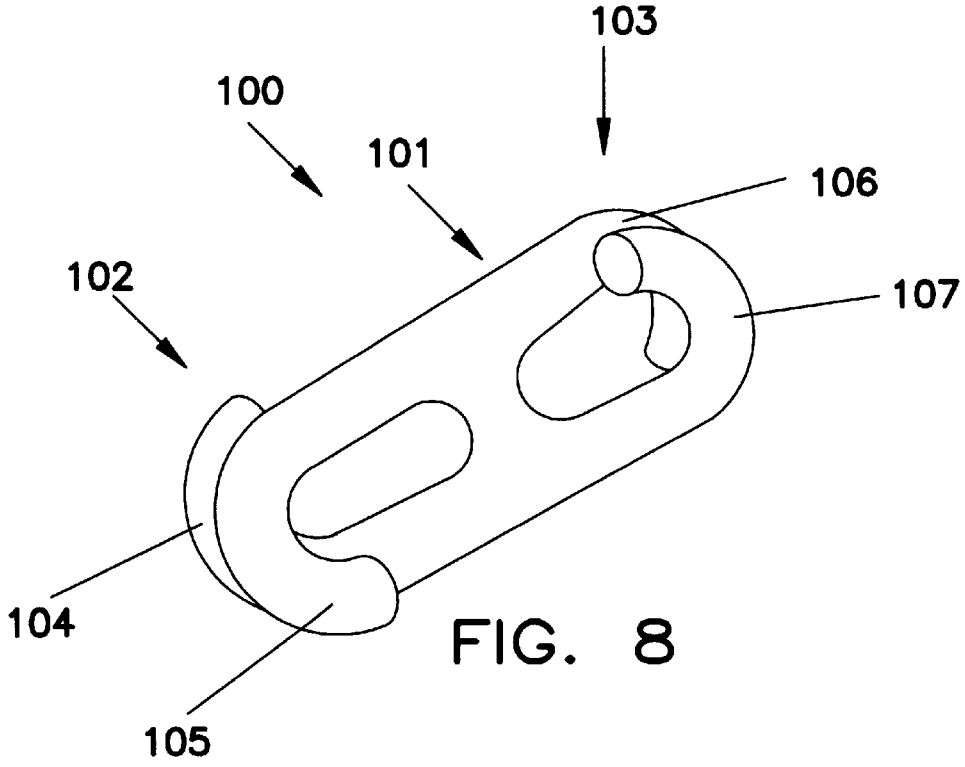
FIG. 8 is a prospective view of another clip of my invention.

FIGS. 8 is a perspective view of another clip of my invention. As shown in FIG. 8, clip 100 is functionally equivalent to the clip 10 of FIGS. 1–4 in every way, the primary difference being the central portion 101 of the FIG. 8 clip does not include a pinched, or indented, portion at its middle.

The eyelet forming and cord engaging portions 102 and 103 are substantially like those of clip 10. The clip of FIG. 8 has an overall length of about 36 mm, end to end, and a height across the eyelet forming and cord engaging portions 102, 103 of about 16 mm. The eyelets themselves have a length of about 12 mm and a height of about 6 to 7 mm. The mouths of the eyelets are formed by each pair of incomplete loops 104, 105 and 106, 107, which are preferably slightly separated (e.g., about 1.5 to 2.0 mm) for easy installation of a cord; however, unlike the clip 10 of FIGS. 1–4, the incomplete loops 104, 105, 106 and 107 are not canted at an angle.

FIGS. 9–15 show another and perhaps preferred method by which the clips 10, 100 may be used to attach a soccer net to a goal framework 33.

Figure 9:
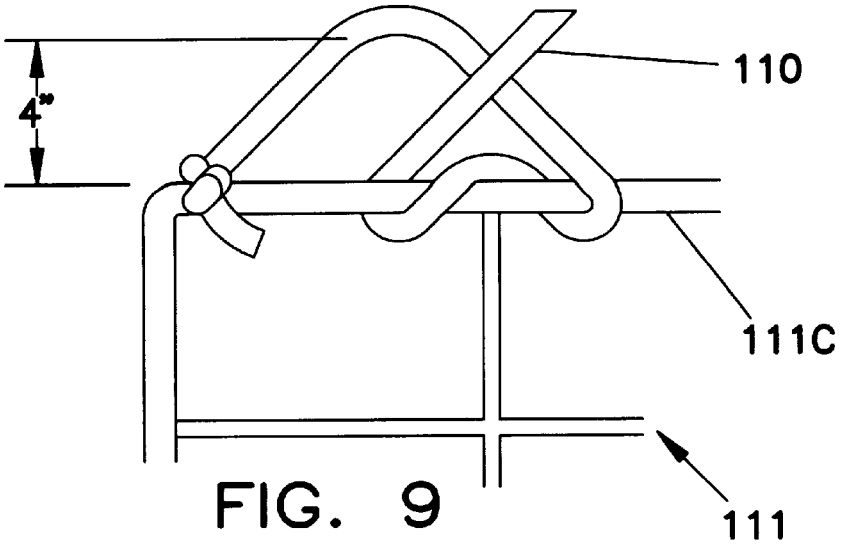
FIGS. 9–15 illustrate one preferred method of attaching a soccer net to a soccer goal framework.
Figure 10:
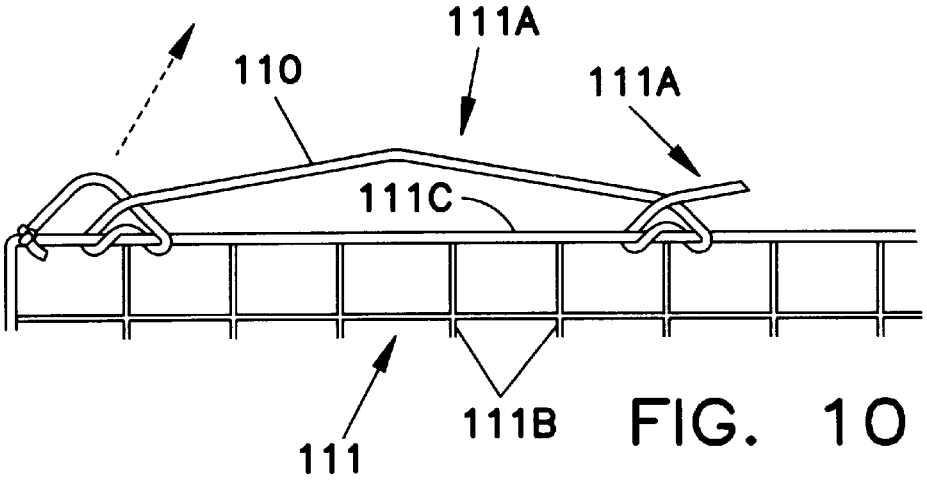
Figure 12:
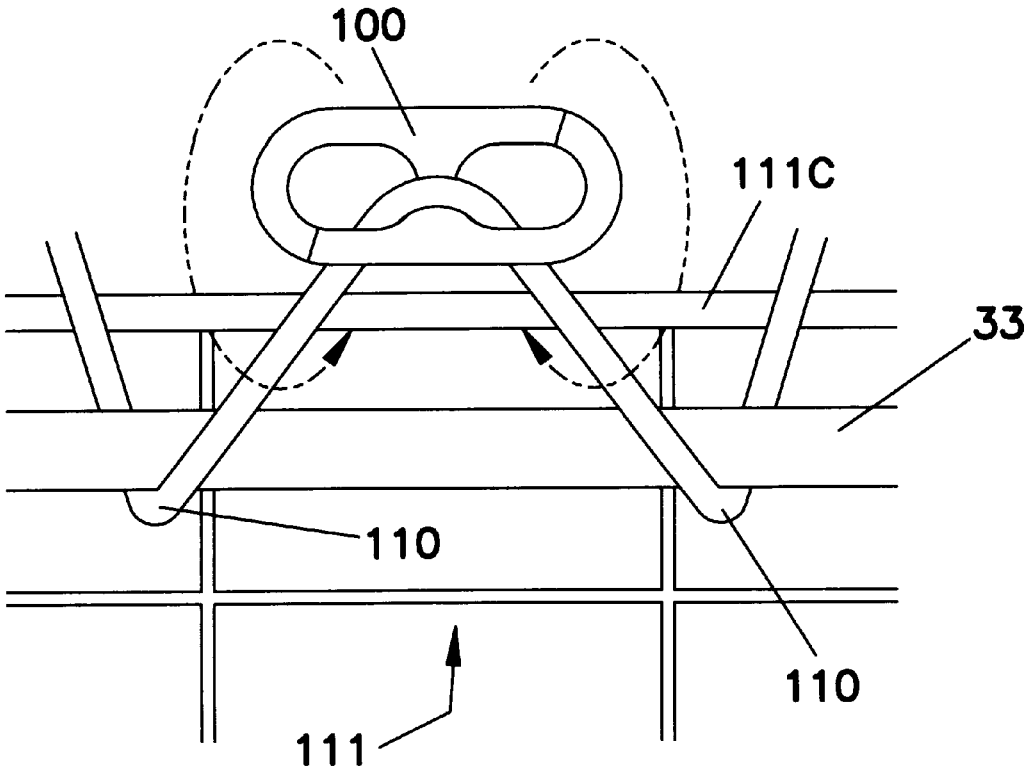
Figure 13:
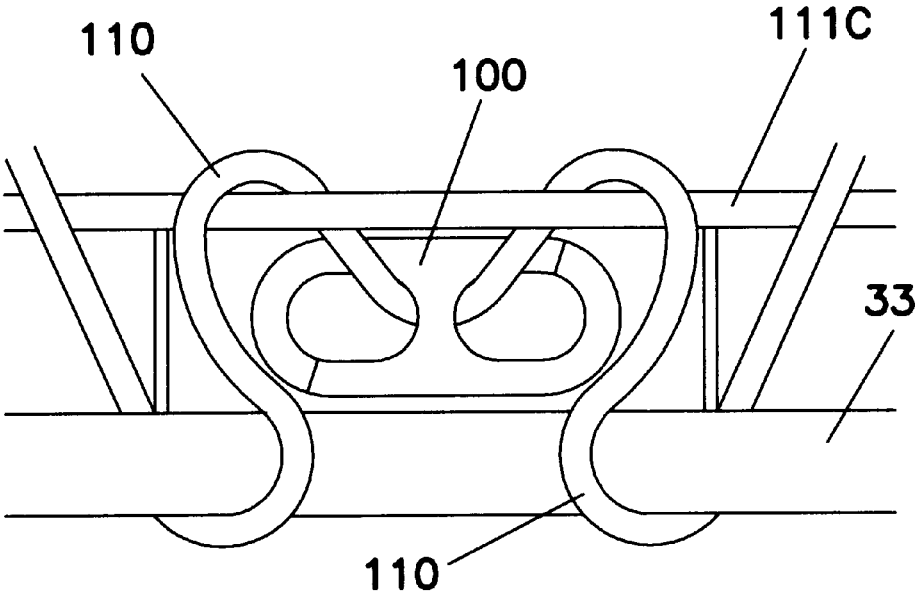
Figure 14:
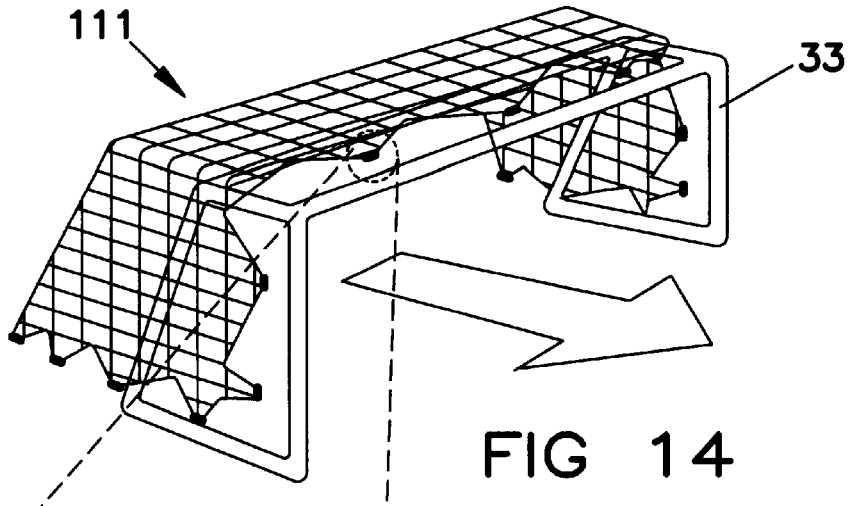
Figure 14A:
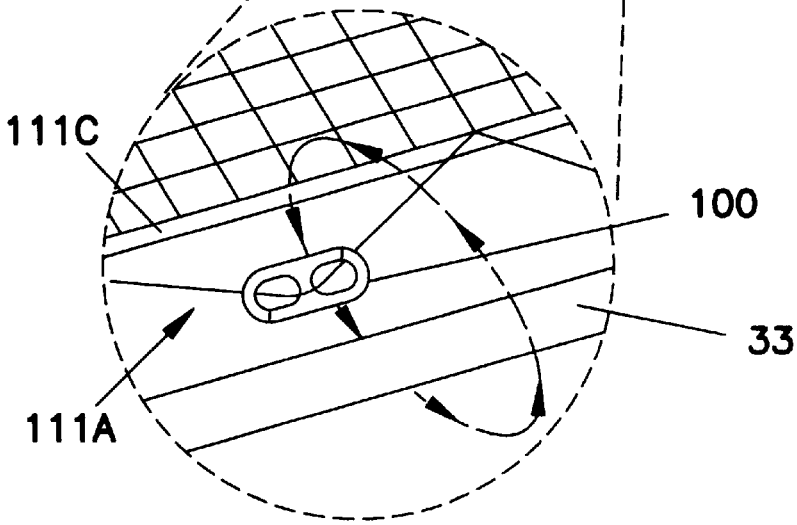

In the method shown by FIGS. 9–15, a cord 110 is tied at one corner of a soccer net mesh 111, as shown in FIG. 9, and the cord 110 is attached to the soccer net 111 to form triangles 111*a* along the periphery of the soccer net 111 as shown in FIGS. 10 and 14, for example, by attaching the cord 110 as shown at every fifth or sixth mesh forming cord 111*b* at the border 111*c* of the net. This procedure is repeated until about an eight foot section of net has been provided with triangles 111*a,* at which point the free end of the cord can be attached to the net 111 with a bow knot. Following this procedure, the entire periphery of the soccer net is provided with looped triangles 111*a*.

Figure 11:
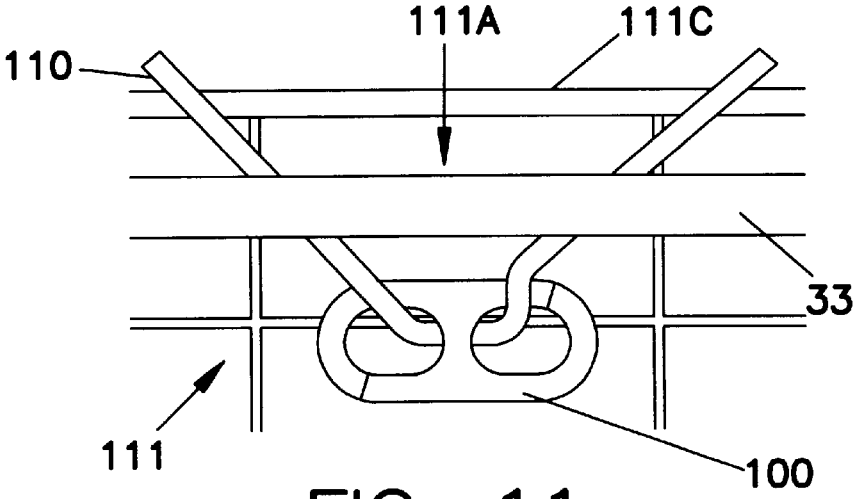

When lacing of the soccer net is completed, a clip 10, 100 is attached to each loop 111*a* as shown in FIG. 11.

The soccer net 111 is then attached to the framework 33 of the soccer goal as shown in FIGS. 12–14. As shown in FIGS. 12 and 13, the cord loop 111*a* and clip 10, 100 is wrapped under and around the goal framework 33 and over and around the outer border 111*c* of the soccer net. With the clip 10, 100, so positioned, the cord 110 forming each side of the triangle 111*a* is pushed into the eyelets of clip 10, 100 where it is trapped.

After each triangular loop 111*a* at the border of the soccer net is so attached to this goal framework 33, the soccer net can be pulled into a tight fit against the goal framework 33 by untying the bow know on each section of cord 110, pulling the cord until the soccer net 111 is snug against the goal framework 112 and re-tying the cords 110.

Figure 15:
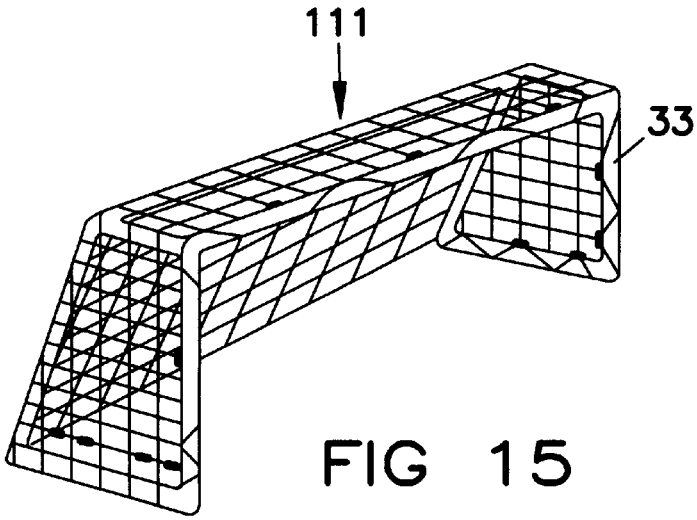

FIGS. 14 and 15 illustrate how a soccer net 111 laced by the method of this invention can be fitted snugly to a goal framework 33.

As indicated above, the presently preferred embodiments of the clip illustrated by FIGS. 1–4 and 8 are adapted to be injection molded using a durable and resilient plastic material, such as polypropylene, nylon, polyvinyl chloride or the like. When so molded, the resilience of the plastic material holds the adjacent distal hook-like portions 14*b* and 15*b,* and 16*b* and 17*b,* respectively, in an adjacent touching, or almost touching, relationship, as shown in FIG. 3, to close the cord entrances 20 and 21, and the resilience of the polypropylene material, particularly in the inner portions 14*a,* 15*a,* 16*a* and 17*a* of the outwardly extending means 12 and 13, permits the outward movement of the respective hooked distal portions 14*b,* 15*b,* 16*b* and 17*b* (as indicated in FIG. 4A) to open the cord entrances 20 and 21, and upon insertion of the cords 30, 31, returns to the distal portions 14*b,* 15*b,* 16*b* and 17*b* to their adjacent relationship, closing cord entrances 20 and 21 and trapping the cords 30, 31 within the cord-engaging eyelets 22, 23. As illustrated in FIG. 2, each of the outwardly extending cord-engaging means 12 and 13 is canted at an acute angle $\alpha$ to assist its formation by injection molding. The clip of FIG. 8 can be used in substantially the same manner.

The clip of this invention is preferably formed by injection molding plastic materials, but those skilled in the art will realize that the methods and targets of the invention may use clips formed from stamped metal or from bent wire and still provide the convenient means of this invention for interconnection of two cords. For example, a clip formed by two stamped elements welded together at their centers to form the interconnecting central portion, with one of the stamped elements forming an outwardly extending inner most portion 14*a* and hooked distal portion 14*b* and an outwardly extending inner portion 16*a* and hooked distal portion 16*b,* with the other stamped element forming outwardly extending inner portion 15*a* and hooked distal portion 15*b* and outwardly extending inner portion 17*a* and hooked distal portion 17*b,* may be used in the invention, although not in its preferred form because of the greater risk associated with the edges of the metal clip, for example, by exposure to cut and puncture wounds.

This invention also provides a flexible soccer goal target 40, through the use of fasteners and strips of soccer netting. As shown in FIG. 5A, a plurality of strips of soccer netting 41–44 can be connected together by fasteners 46 and provide an assembled net having sufficient height and width to extend completely across the entrance of the soccer goal (as shown in FIG. 5B). This net assembly, comprising a plurality of strips of soccer net 41–44 attached together, edge to edge, with a plurality of fasteners 46 can be fastened to the framework forming the soccer goal entrance as indicated in FIG. 5B. The fasteners 46 permit the strips of soccer netting 41–44 to be disconnected one from the other and, at their periphery, from the goal framework 33 to form an opening 50 at the goal entrance to serve as a target for practice shots by players, as shown in FIG. 5B. By the judicious disconnection of fasteners 46, target areas may be formed at various locations in the goal entrance, for example, at the upper right, and/or the lower right (as shown), and/or the upper left, and/or the lower left, which are goal entrance areas frequently difficult a the soccer goalie to cover.

Figure 6B:
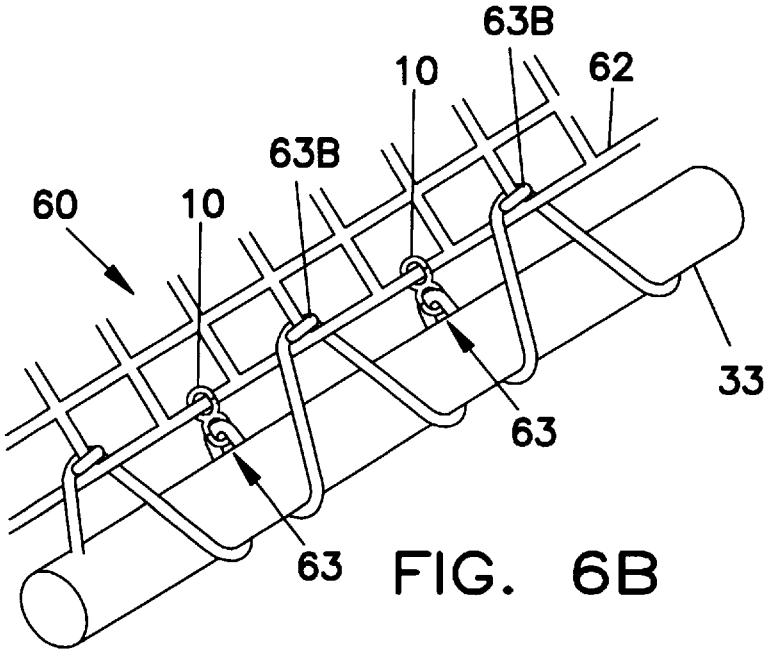
FIG. 6B illustrates the soccer net of FIG. 6A attached to a portion of a soccer goal.

As indicated above, the peripheral parts of the plurality of strips of soccer netting 41–42 that are adjacent the soccer goal can be provided with permanent net attachment means 63, as shown in FIG. 6A, and the peripheral parts of the flexible soccer goal target can be used to fasten the flexible soccer goal target to a soccer goal as shown in FIGS. 6A and 6B.

Figure 7:
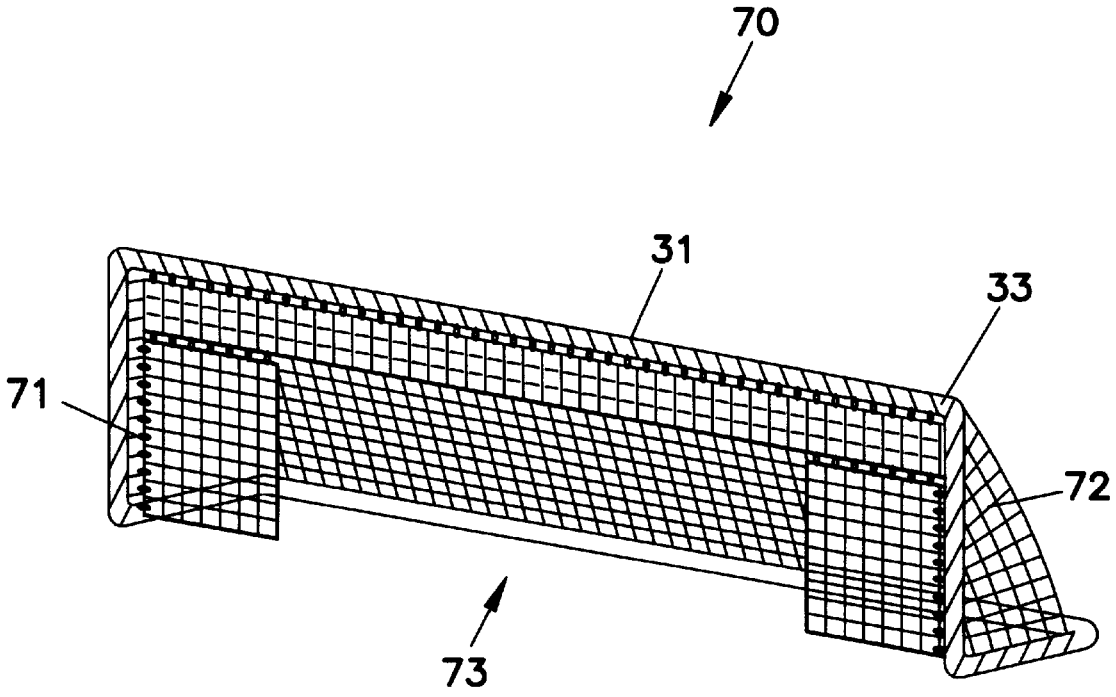
FIG. 7 illustrate use of target assembly to convert a full size soccer goal for junior soccer use.

The soccer target device of the invention can also provide target areas in a central location of the goal entrance by using strips of soccer netting (see 41*a* and 41*b* of FIG. 5B) which extend only partially across the goal entrance and which are connected together in the central portion of the goal entrance by fasteners 46. In a very advantageous use of my flexible soccer goal target, shown in FIG. 7, my soccer goal target 70 includes at least two strips 71, 72 of soccer goal netting in its lower portion that are disconnectable in their central portions and can be opened and connected to the soccer goal frame work 33 and/or the remainder of their outward netting portions to form a central goal opening 73 of the proper size for junior soccer. Thus, my flexible soccer goal target can obviate the need to buy junior-size soccer goals by providing full size soccer goals with junior soccer sized openings, as shown in FIG. 7.

A clip 10 of the invention (FIGS. 1–3 and 8) may be advantageously used in the target assembly 40 of this invention and the preferred method of interconnection shown in FIGS. 4B and 4C and described above may be used to interconnect the strips of netting. It must be understood, however, that target assemblies of my invention may incorporate any fastener and method that may be easily and conveniently used to connect and disconnect strips of netting.

It is not necessary in the target assembly 40 of the invention that the plurality of strips 41–44 be of equal height, nor is it necessary that any given width be used. It is only necessary that the width of the strips be sufficient to close a substantial portion, for example, one-half or more, of a soccer goal entrance. It should be further apparent that the internal openings of by the netting used in this target assembly 40 of my invention may be of any size, provided the cord used in the formation of the goal be of a material and size to be durable and economic.

While I have described the preferred embodiment of my invention currently known to me, it will be apparent to those skilled in the art that other embodiments of this invention may be devised without departing from the scope of my invention as set forth in the following claims and defined by the prior art.

I claim:

1. A soccer goal target, comprising a plurality of strips of netting, each strip of netting having a height at least large enough to define an opening suitable as a target for a soccer ball, and a plurality of fasteners adapted to interconnect said strips of netting;

said plurality of strips being interconnected by said plurality of fasteners and providing, when interconnected, a net assembly with sufficient width and height to close a substantial portion of a soccer goal entrance;

wherein openings of varying size and location can be formed by disconnecting one or more of the plurality of strips over a predetermined distance and forming thereby a target opening.

2. The soccer goal target of claim 1 wherein said plurality of strips includes at least two strips that have insufficient width to extend across the soccer goal entrance and may be fastened together at their inner ends within the soccer goal entrance or may be fastened by their inner ends to adjacent portions of the net assembly to form a central opening.

3. The soccer goal target of claim 2 wherein said at least two strips are located at the bottom of the soccer goal target and have a height equal to the height of a junior soccer goal, and can be disconnected within the soccer goal entrance and reconnected with the plurality of fasteners to convert a full size soccer goal to a junior size soccer goal.

4. The soccer goal target of claim 1 wherein portions of the peripheries of the plurality of strips of netting are provided with a plurality of netting attachment means.

5. The soccer goal target of claims 4 wherein the plurality of netting attachment means comprise a plurality of cord loops attached at spaced locations on the peripheries of each of the plurality of strips of netting.

6. A soccer goal target, comprising a plurality of strips of netting, each strip of netting having a height at least large enough to define an opening suitable as a target for a soccer ball, and a plurality of fasteners adapted to interconnect said strips of netting, each of said plurality of fasteners comprising a central interconnecting portion with two pairs of adjacent incomplete loops extending outwardly from the central portion and forming a pair of interconnected eyelets, each incomplete loop of each pair of adjacent incomplete loops including a hooked distal portion lying adjacent a hooked distal portion of the other incomplete loop and forming a cord entrance so that upon insertion of a cord between the hooked distal portions of the incomplete loops, the cord will be entrapped in the eyelet formed thereby;

said plurality of strips being interconnected by said plurality of fasteners and providing, when interconnected, a net assembly with sufficient width and height to close a substantial portion of a soccer goal entrance;

wherein openings of varying size and location can be formed by disconnecting one or more of the plurality of strips over a predetermined distance and forming thereby a target opening.

7. A method of forming a target for soccer practice, comprising providing a plurality of strips of netting;

providing a plurality of cord-engaging fasteners;

connecting the plurality of strips together into a target assembly with said plurality of fasteners, in height and width sufficient to extend substantially across a soccer goal entrance framework;

attaching the periphery of the target assembly to the soccer goal entrance framework to extend substantially across the goal entrance; and disconnecting a plurality of said fasteners that connect at least one strip of netting to form an opening in the goal entrance for use as a target.

8. The method of claim 7 wherein the plurality of fasteners disconnected to form the target opening are used to fasten the at least one strip to the remainder of the target assembly.

9. The method of claim 7 wherein the plurality of fasteners comprise a central interconnecting portion with two pairs of adjacent incomplete loops extending outwardly from the central portion and forming a pair of interconnected eyelets, each incomplete loop of each pair of adjacent incomplete loops including a hooked distal portion lying adjacent a hooked distal portion of the other incomplete loop and forming a cord entrance so that upon insertion of a cord between the hooked distal portions of the incomplete loops, the cord will be entrapped in the eyelet formed thereby.

10. A method of attaching netting, comprising attaching a plurality of clips at a plurality of openings in the netting at the periphery of the netting, said clips being spaced at the periphery of the netting with intervening unclipped net openings, lacing a cord through the intervening unclipped net openings and forming a plurality of loops in the cord adjacent the plurality of clips, and wrapping the plurality of loops around an object to be attached to the netting and attaching the ends of the plurality of loops to the plurality of clips to secure the netting to the object.

11. The method of claim 10 wherein the object is netting and the plurality of loops are threaded through the openings of adjacent netting and wrapped around the netting cord and attached to the plurality of clips.

12. The method of claim 10 wherein the object is an elongated framework member.

13. The method of claim 12 wherein the elongated framework member is a portion of a soccer goal framework.

14. Soccer netting, comprising:

a plurality of clips, a plurality of cords interconnected to form a netting with a plurality of openings and a netting periphery, and a plurality of loops formed from cord, each of said plurality of loops being attached to and spaced about the netting periphery and extending outwardly from their attachment at the netting periphery, allowing the loop to be wrapped around and attached to a soccer goal by its engagement with at least one of said clips.

15. The soccer netting of claim 14 wherein the plurality of spaced cord loops are formed by one or more cords attached to the netting periphery at spaced locations and deformable into triangular loops.

16. A method of forming a target for soccer practice, comprising providing a plurality of strips of netting;

at least two of the plurality of strips of netting having a width insufficient to extend substantially across the soccer goal entrance and a height equal to the height of a junior soccer goal; and substantially across a soccer goal entrance framework to form a netting assembly;

attaching the periphery of the netting assembly to the soccer goal entrance framework; and using one or more fasteners to connect the inner ends of said at least two strips of netting to the adjacent portions of the netting assembly to form a central opening having a width equal to a junior soccer goal, thereby converting a full size soccer goal entrance into a junior size soccer goal entrance.

* * * * *